US007108566B2

(12) United States Patent
Kressmann et al.

(10) Patent No.: US 7,108,566 B2
(45) Date of Patent: Sep. 19, 2006

(54) ELECTRICAL PLUG CONNECTOR

(75) Inventors: Markus Kressmann, Frankfurt (DE); Guenther Mumper, Egelsbach (DE); Konrad Helmut Roth, Fraenkisch-Crumbach (DE); Bart Van Sebroeck, Bensheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 11/065,498

(22) Filed: Feb. 24, 2005

(65) Prior Publication Data

US 2005/0272285 A1 Dec. 8, 2005

(30) Foreign Application Priority Data

Feb. 24, 2004 (EP) ..... 04004159

(51) Int. Cl.
*H01R 4/66* (2006.01)
*H01R 13/516* (2006.01)

(52) U.S. Cl. ..... 439/701; 439/924.1

(58) Field of Classification Search ..... 439/701, 439/924.1

See application file for complete search history.

(56) References Cited

U.S. PATENT DOCUMENTS 5,344,347 A * 9/1994 Inoue et al. ..... 439/701
5,472,357 A 12/1995 Yamanashi
5,775,953 A * 7/1998 Yamanashi et al. ..... 439/701
5,913,703 A * 6/1999 Suzuki et al. ..... 439/701

FOREIGN PATENT DOCUMENTS

DE 103 20 460 A1 12/2003
EP 0 590 496 A1 4/1994
EP 0 803 941 A2 10/1997
EP 0 803 941 A3 10/1997

OTHER PUBLICATIONS

European Search Report dated May 10, 2005 for Application No. EP 05 00 2729.

* cited by examiner

*Primary Examiner*—James R. Harvey
(74) *Attorney, Agent, or Firm*—Barley Snyder LLC

(57) ABSTRACT

An electrical plug connector includes a first housing and a second housing. The first housing includes first electrical contacts arranged in first and second contact zones. The second housing includes second electrical contacts arranged in first and second contact holders. The second contact holder is displaceable with respect to the second housing in a direction of mating when the first and second housings are mated. The second contact holder is displaceable between a first position where the second electrical contacts of the second contact holder mechanically engage the first electrical contacts and a subsequent second position where the second electrical contacts of the first contact holder mechanically engage the first electrical contacts.

12 Claims, 10 Drawing Sheets

ELECTRICAL PLUG CONNECTOR

FIELD OF THE INVENTION

The invention relates to an electrical plug connector comprising a first housing and a second housing wherein the second housing has a separately displaceable contact module that enables the first housing and the second housing to be mated and/or unmated with a low force.

BACKGROUND OF THE INVENTION

Electrical plug connectors are used in a variety of technical fields. For example, electrical plug connectors are used in the automotive industry to connect electrical terminals. The electrical plug connector prevents the terminals from becoming loose when the terminals are exposed to jolts and vibrations. In the automotive industry, the electrical plug connector is typically used in door modules where a plurality of actuators and servo motors are used that require electrical supply lines to connect the actuators and servo motors to on-board power supply and control devices. Using the electrical plug connector in vehicle doors is beneficial, because the electrical supply lines may be disconnected in the event the vehicle door needs to be removed. The electrical plug connector may also be used in vehicle seats, which are also typically provided with a plurality of servo motors and actuators.

Conventional electrical plug connectors comprise a first housing having a plurality of pin contacts that mate with a second housing have a plurality of socket contacts. Each of the socket contacts is associated with one of the pin contacts. One example of such an electrical plug connector is disclosed in DE 10320460 A1. The first housing and the second housing are pushed together in order to make an electrical connection between the pin contacts and the socket contacts. A relatively high insertion force is required to bring the pin contacts into mechanical contact with the socket contacts. Additionally, when the first housing is detached from the second housing, a relatively high pulling force is required to disconnect the pin contacts from the socket contacts. As a result of these high forces, it is necessary to securely fix either the first housing or the second housing in a support structure of the motor vehicle. Additionally, pushing and/or pulling aids must be used to apply the high forces needed when the first and second housings are mated and/or unmated.

SUMMARY OF THE INVENTION

It is therefore an object of the invention to provide an electrical plug connector wherein the force required to connect and/or disconnect the first and second housings is reduced.

This and other objects are achieved by an electrical plug connector comprising a first housing and a second housing. The first housing includes first electrical contacts arranged in first and second contact zones. The second housing includes second electrical contacts arranged in first and second contact holders. The second contact holder is displaceable with respect to the second housing in a direction of mating when the first and second housings are mated. The second contact holder is displaceable between a first position where the second electrical contacts of the second contact holder mechanically engage the first electrical contacts and a subsequent second position where the second electrical contacts of the first contact holder mechanically engage the first electrical contacts.

DETAILED DESCRIPTION OF THE INVENTION

Figure 1:
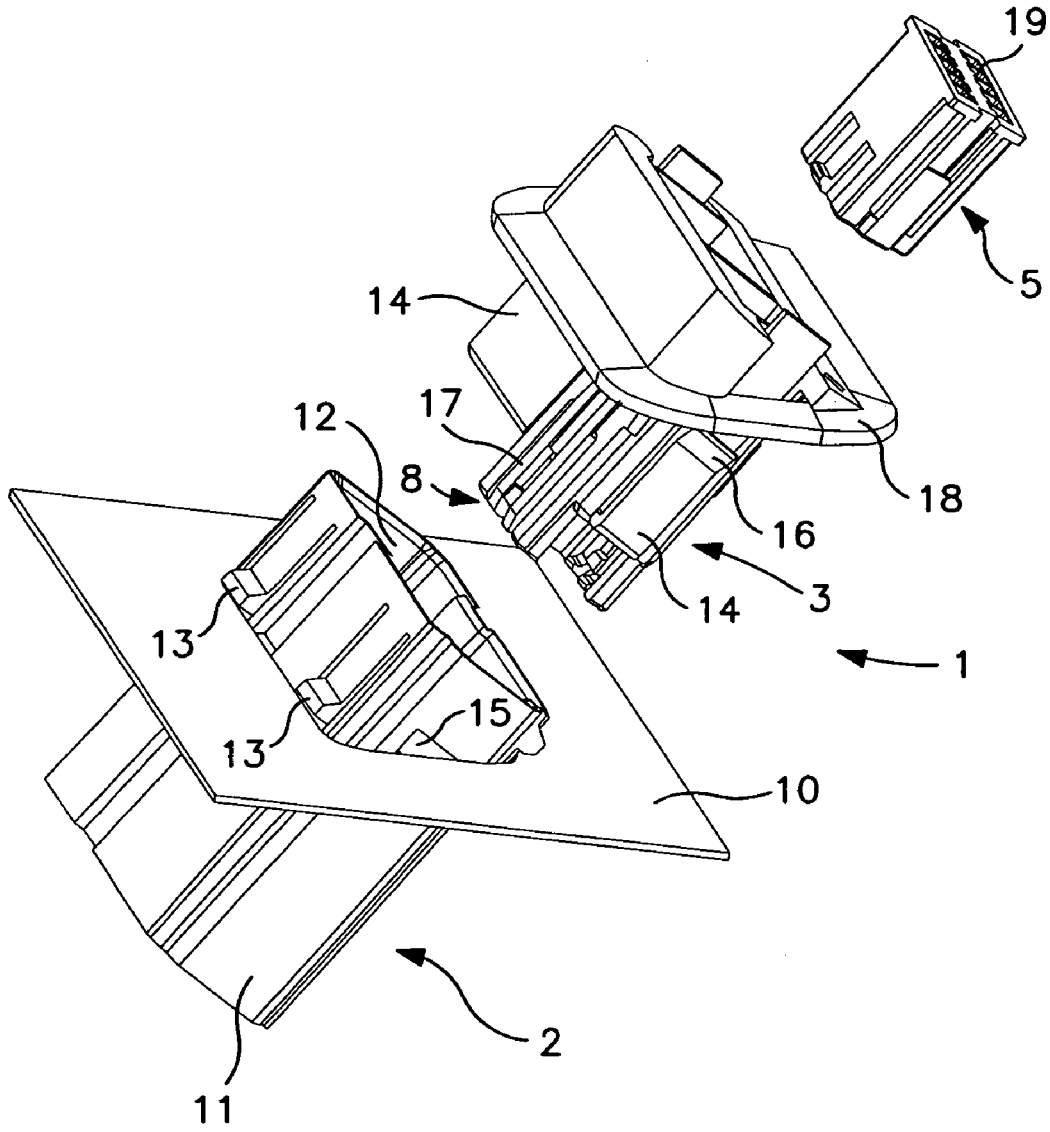
FIG. 1 is an exploded view of an electrical plug connector according to the invention.

FIG. 1 shows an electrical plug connector 1 consisting of a first plug element and a second plug element. The first plug element consists of a first housing 2. The second plug element consists of a second housing 3 and a displaceable module or second contact holder 5.

As shown in FIG. 1, the first housing 2 has a first housing wall 11 having a substantially rectangular cross-section. The first housing wall 11 defines a second housing receiving opening 12. The second housing receiving opening 12 has a cross-section such that the second housing 3 may be received in the second housing receiving opening 12. The first housing wall 11 is formed to guide the second housing 3 into the second housing receiving opening 12 in a direction of mating. Attachment members 13 extend from the first housing 2. The attachment members 13 may be formed, for example, as latching hooks. The attachment members 13 are formed to secure the first housing 2 to a support structure 10. In the embodiment illustrated, for example, the first housing 2 is secured by the attachment members 13 in an opening of a piece of sheet-metal of a motor vehicle body, such as a pillar of a motor vehicle. Opposing faces of short sides of the first housing 2 have holding member engaging recesses 15.

Figure 4:
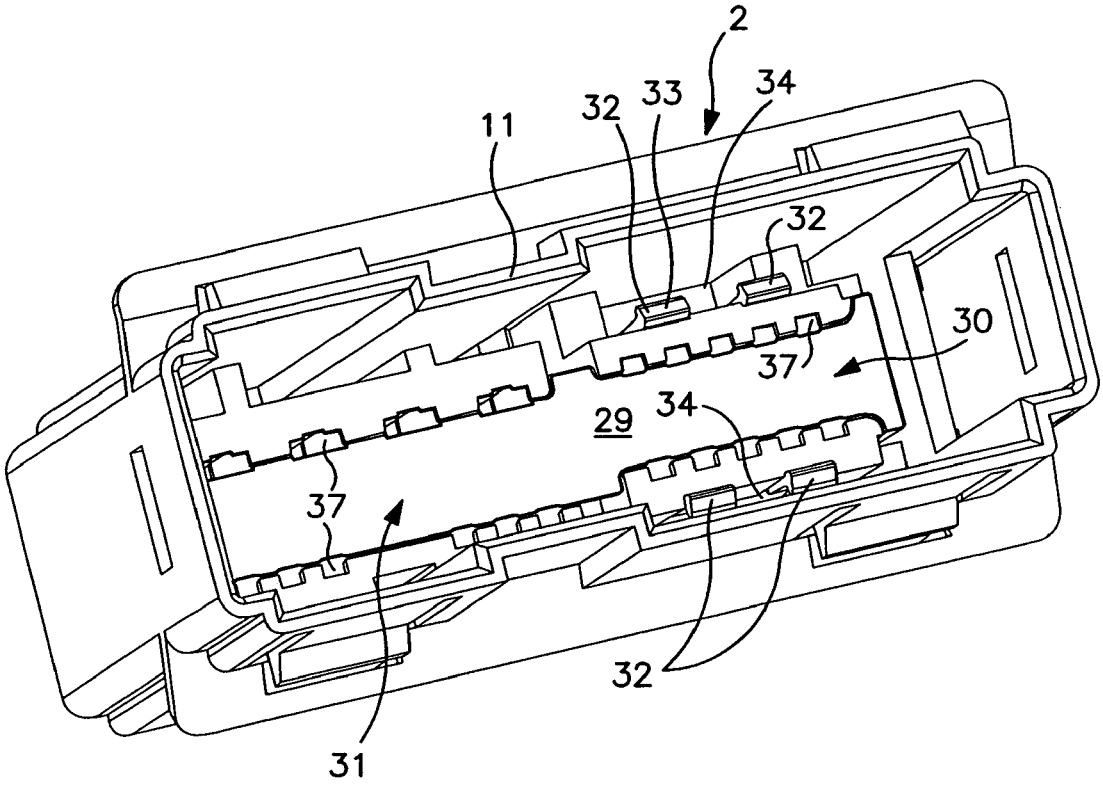
FIG. 4 is a perspective view of a first housing.
Figure 9:
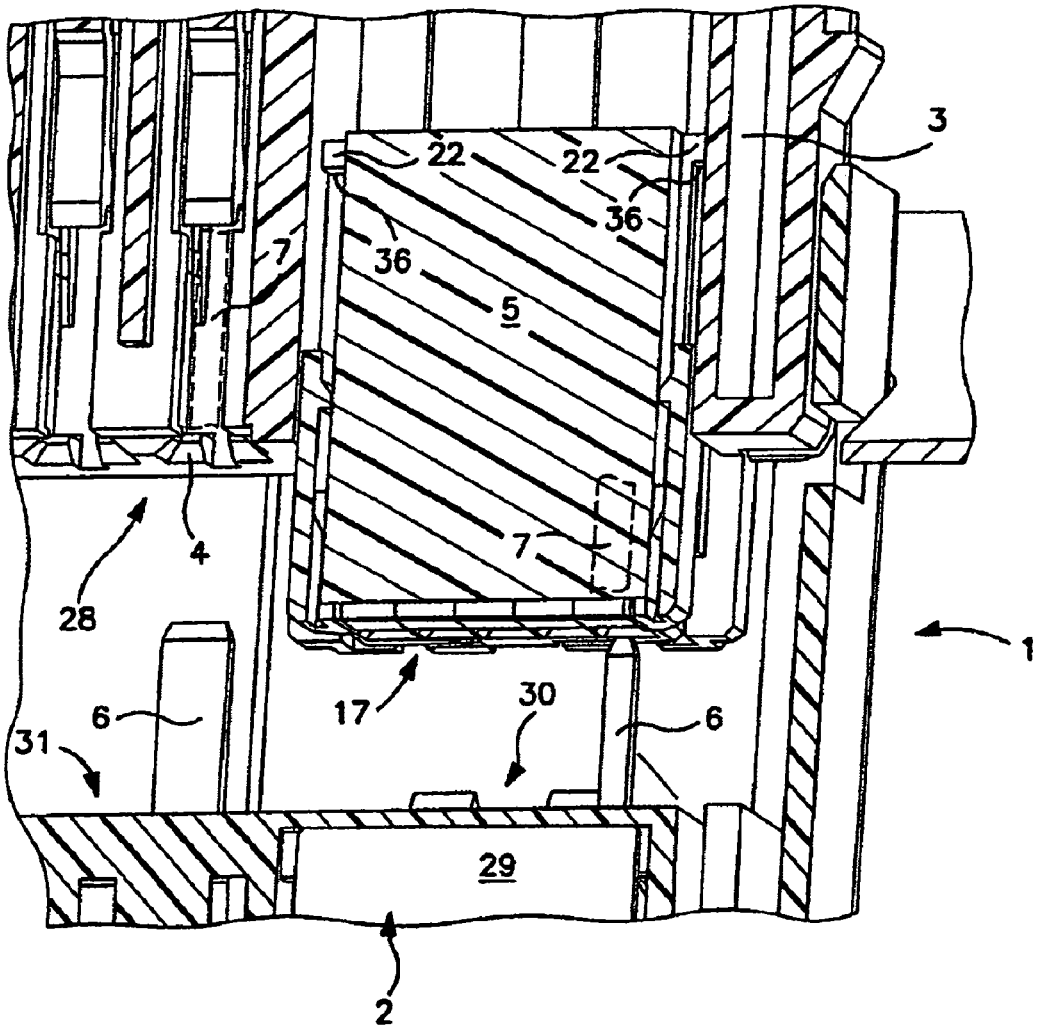
FIG. 9 is a cross-sectional view of the electrical plug connector showing first electrical contacts of the first housing partially mated with second electrical contacts of the second contact holder of the second housing.
Figure 10:
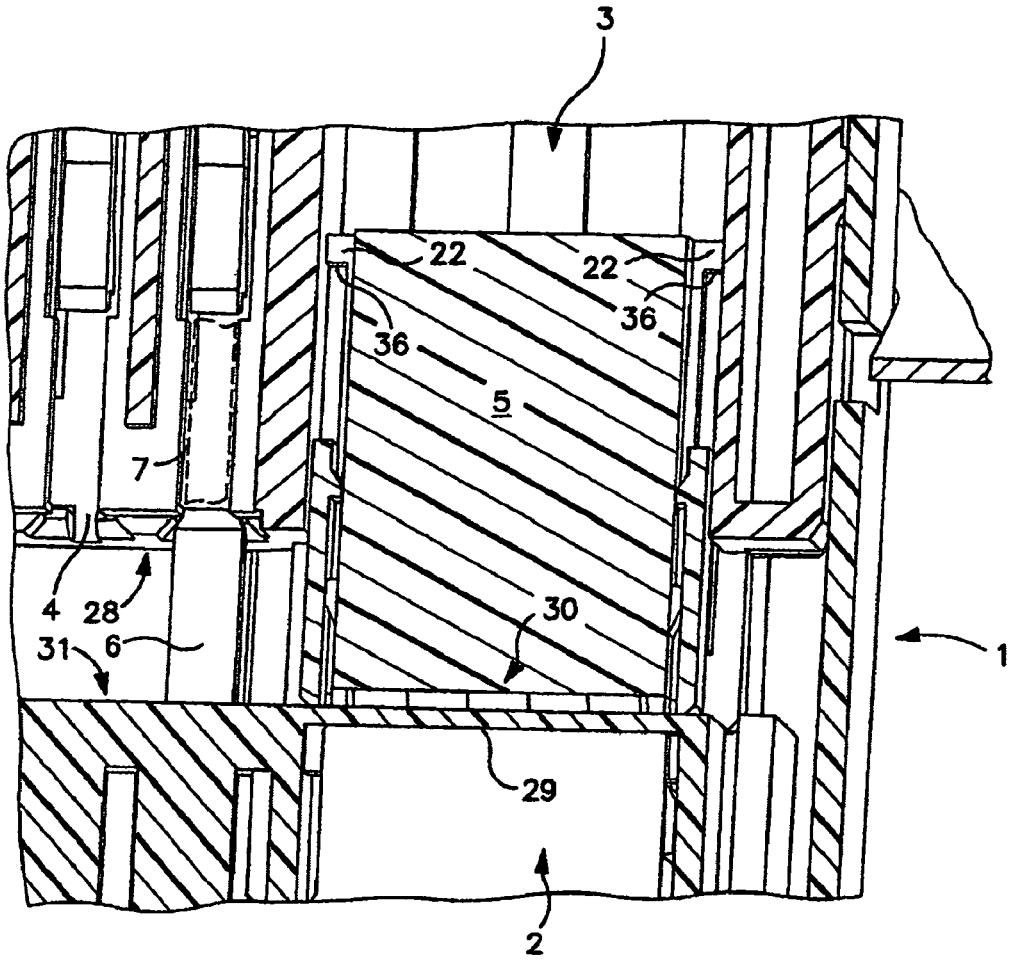
FIG. 10 is a cross-sectional view of the electrical plug connector showing the first electrical contacts of the first housing partially mated with the second electrical contacts of a first contact holder of the second housing.

As shown in FIG. 4, the second housing receiving opening 12 has first and second contact zones 30, 31, respectively. The first and second contact zones 30, 31 are formed adjacent to one another in a contact base 29 of the first housing 2. The first contact zone 30 and the second contact zone 31 may be formed, for example, at the same level. The first and second contact zones 30, 31 are surrounded by the first housing wall 11. First contact openings 37 are provided in the first and second contact zones 30, 31. The first contact openings 37 are of varying construction and receive and hold first electrical contacts 6. The first electrical contacts 6 may be, for example, pin contacts. Only a few of the first electrical contacts 6 are illustrated for simplicity and are shown in FIGS. 9 and 10. All of the first electrical contacts 6 of the first housing 2 may be, for example, arranged in a single plane so that the first housing 2 may have a relatively short construction.

On opposing sides of the first contact zone 30 are latching hook receiving openings 34 and release members 32. The release members 32 are arranged adjacent to one another and are directed upwards. The release members 32 are arranged to be symmetrical and each of the release members 32 has a beveled outer surface 33 having a wedge shape. The release members 32 may be formed in one piece with the first housing 2. The second housing receiving opening 12 has inward and outward curves corresponding to an external contour of a second housing wall 14 such that the second housing 3 can only be received in the first housing 2 in an orientation where the second contact holder 5 is associated with the first contact zone 30.

Figure 3:
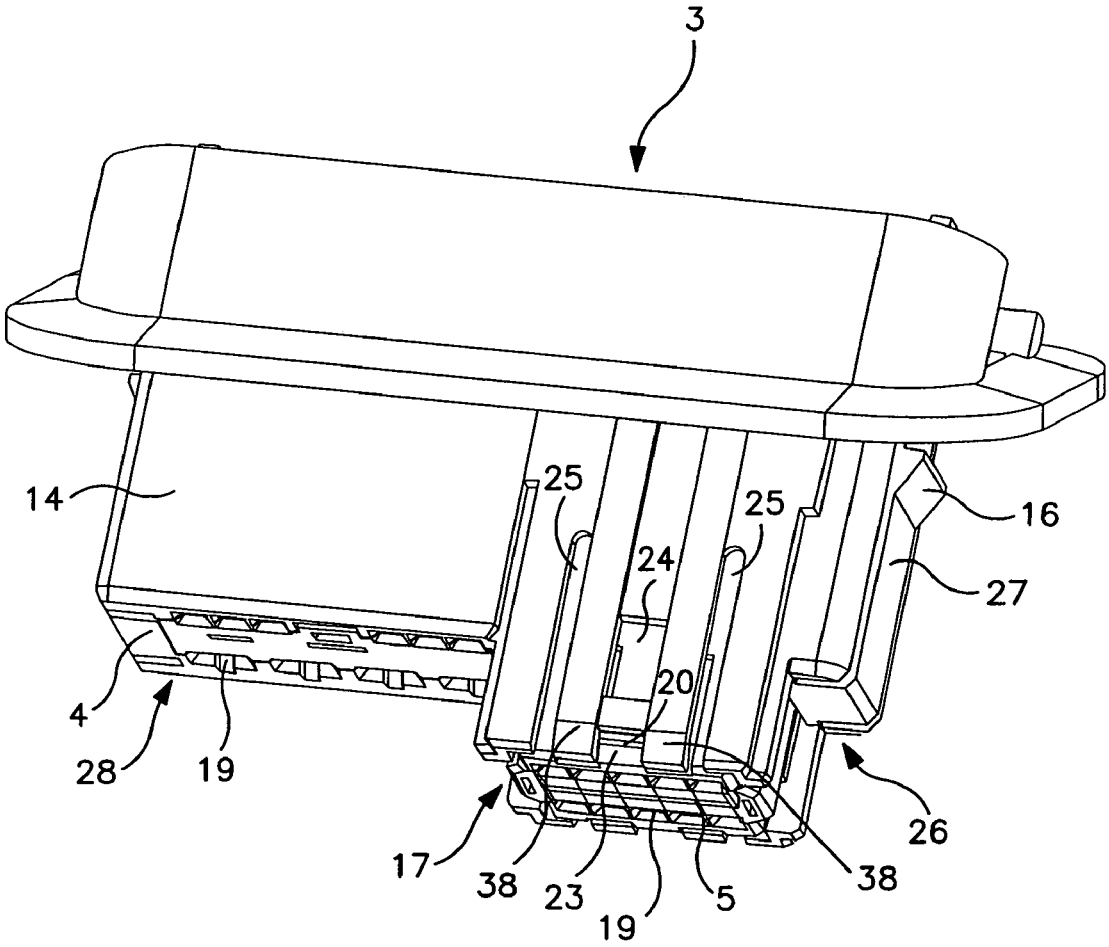
FIG. 3 shows a perspective view of a second housing with the second contact holder.

As shown in FIG. 3, the second housing wall 14 of the second housing 3 has a substantially rectangular cross-section. The opposite sides of the second housing wall 14, which are not visible, are formed to be symmetrical to the visible sides of the second housing wall 14. The cross-section of the second housing wall 14 corresponds to the second housing receiving opening 12 in the first housing 2 such that the second housing 3 may be received at least partly in the first housing 2 in the direction of mating. On opposing sides of the second housing 3 are holding members 16 corresponding to the holding member engaging recesses 15 of the first housing 2. The holding members 16 engage the holding member engaging recesses 15 in the first housing 2 when the second housing 3 is received in the second housing receiving opening 12. The second housing wall 14 has a step 26 on a side 27 thereof for facilitating orienting and pushing the second housing 3 into the second housing receiving recess 12. As shown in FIG. 1, a peripheral seal 18 is constructed peripherally around the second housing wall 14 and bears in a sealing manner against the second housing 3.

As shown in FIG. 3, the second housing 3 has a first region 17 and a second region 28. The second region 28 is set back with respect to the first region 17 by a step. The second region 28 is set back in a direction opposite to the direction of mating. The second region 28 has a first contact holder 4 that is fixedly connected to the second housing 3. The first contact holder 4 has second contact openings 19 for receiving and holding second electrical contacts 7. The second electrical contacts 7 may be, for example, socket contacts or contact clips. Only a few of the second electrical contacts 7 are illustrated for simplicity and are shown in FIGS. 9 and 10.

Figure 7:
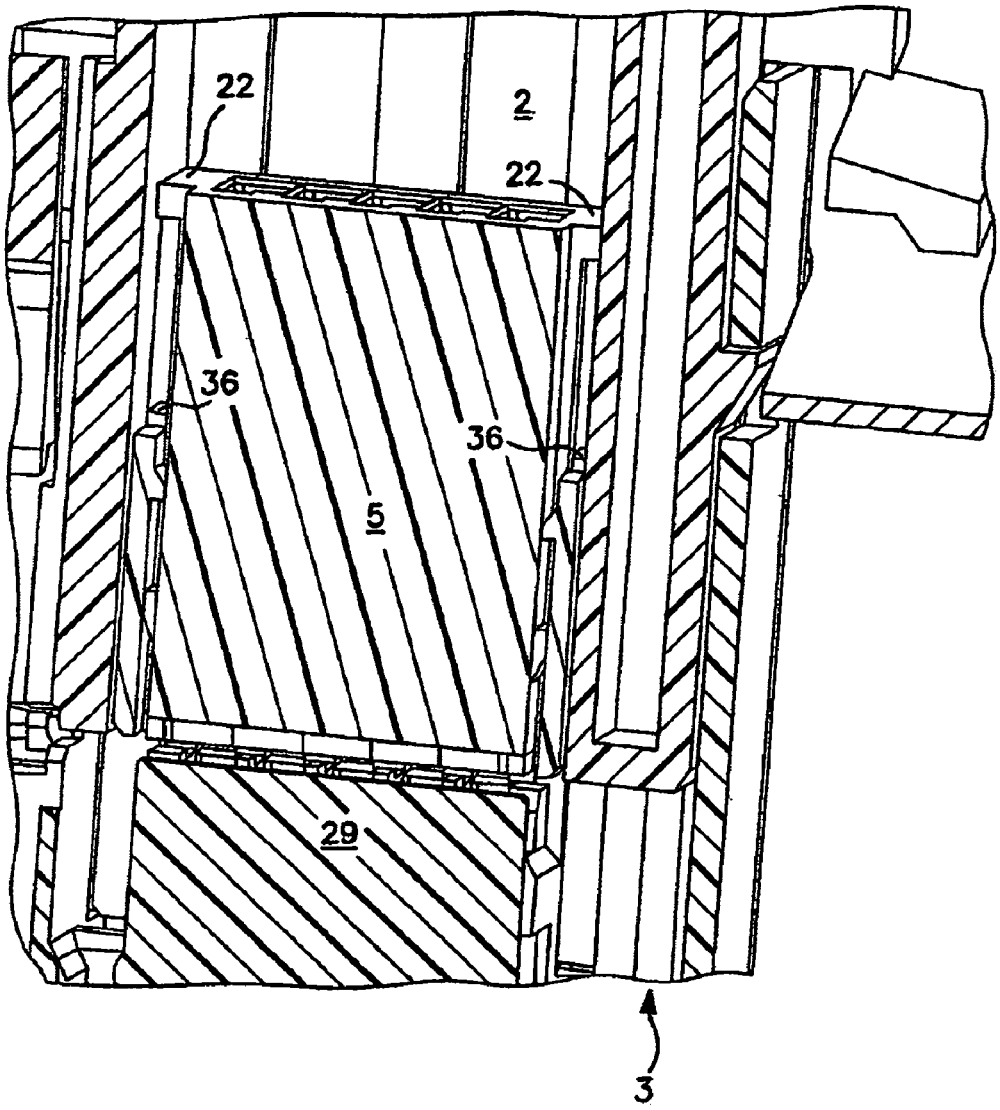
FIG. 7 is a partial cross-sectional view of the electrical plug connector showing the second contact holder mated with the first housing.

As shown in FIG. 3, the first region 17 is constructed in the form of a receiving member 8 for receiving and guiding the second contact holder 5. As shown in FIG. 7, the second housing 3 has an abutment member 36 on an inside of the receiving member 8 in which the second contact holder 5 is mounted such that it is axially movable. As shown in FIG. 3, the first region 17 may be inwardly offset in a lateral direction. In the first region 17, the second housing wall 14 is constructed to be longer in the direction of mating. A first latching projection receiving recess 23 is provided in the second housing wall 14. The first latching projection receiving recess 23 opens in the direction of mating. A second latching projection receiving recess 24 is made in the second housing wall 14 above the first latching projection receiving recess 23 and opposite to the direction of mating. The first and second latching projection receiving recesses 23, 24 may be formed in spring tabs 38 on the second housing wall 14. The spring tabs 38 may have a flexible and resilient construction and may consist of parallel webs that are separated from the second housing wall 14 by parallel longitudinal slots 25.

Figure 2:
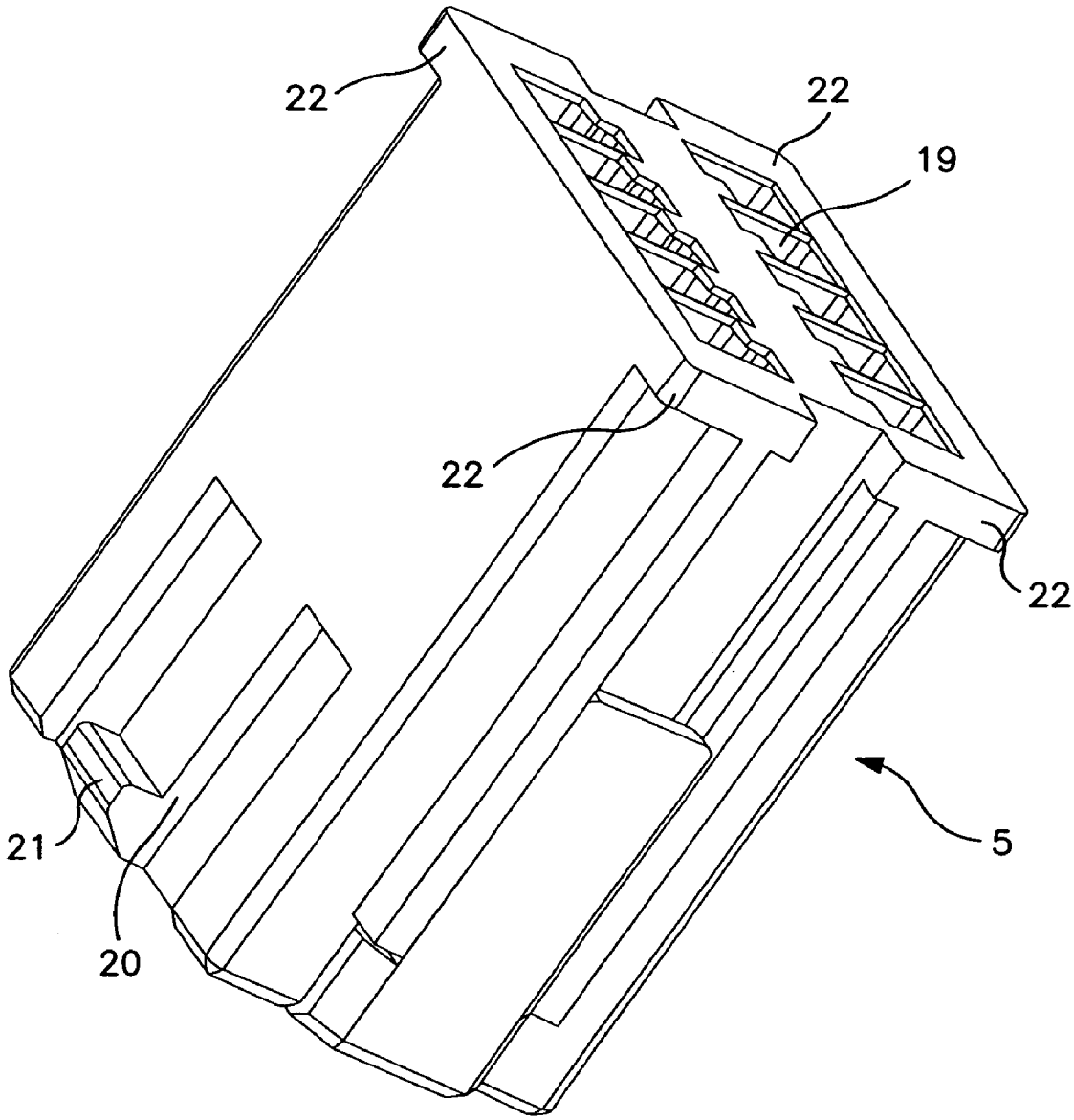
FIG. 2 is a perspective view of a second contact holder.

As shown in FIG. 2, the second contact holder 5 is substantially cubical in shape and is constructed as an insert part. The opposite sides of the second contact holder 5, which are not visible, are formed to be symmetrical to the visible sides of the second contact holder 5. The second contact holder 5 has the second contact openings 19 that receive and hold the second electrical contacts 7. Only a few of the second electrical contacts 7 are illustrated for simplicity and are shown in FIGS. 9 and 10. The second contact openings 19 extend all the way through the second contact holder 5. On opposing side faces of the second contact holder 5 are latching hooks 20. The latching hooks 20 may be formed, for example, in one piece with a wall of the second contact holder 5. In an end region and at a front of the second contact holder 5 in relation to the direction of mating, each of the latching hooks 20 has a latching projection 21 that extends outward. On an end opposite to the latching hooks 20, the second contact holder 5 has at least in a partial region outwardly projecting collars 22. The collars 22 may be formed, for example, in each corner region of the second contact holder 5.

The first and second housings 2, 3 and the first and second contact holders 4, 5 may be made, for example, from an insulating material, such as a synthetic, which is suitable for an injection molding process.

The assembly of the electrical plug connector 1 will now be described. FIG. 3 shows the second contact holder 5 arranged in a first position. In the first position, the second contact holder 5 is arranged in the first region 17 of the second housing 3 such that the second contact holder 5 is displaceable in the direction of mating. A front side of the second contact holder 5 is arranged virtually flush with a lower edge of the first region 17 of the second housing wall 14. The second contact holder 5 is fixed in the first position by the latching hooks 20, which engage the first latching projection receiving recesses 23 and the spring tabs 38 in the second housing wall 14. The latching hooks 20 are used to secure the second contact holder 5 detachably to the second housing 3.

Figure 5:
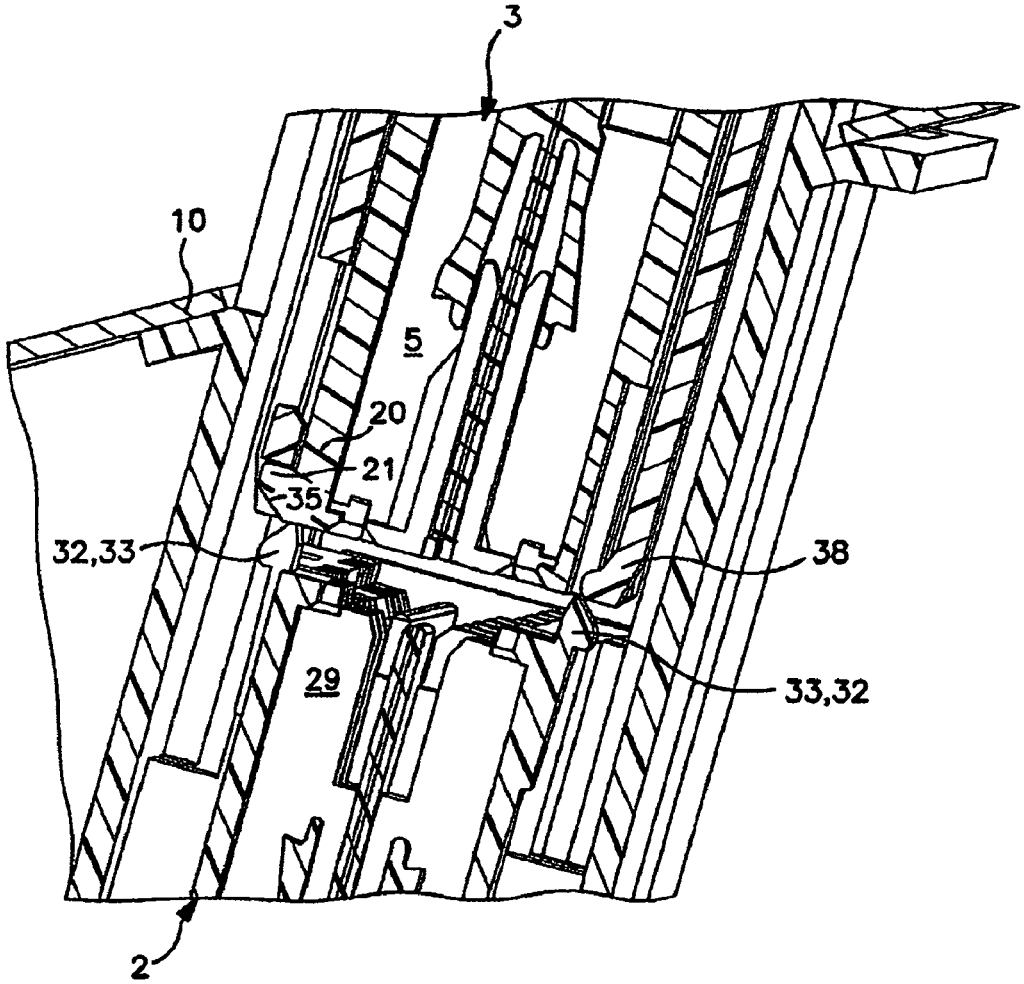
FIG. 5 is partial cross-sectional view through the electrical plug connector showing the first and second housings partially mated.

The second housing 3 is then inserted into the second housing receiving recess 12 of the first housing 2. FIG. 5 is a cross-section of the electrical plug connector 1 showing the second contact holder 5 in the first position and the second housing 3 partially received in the first housing 2. The cross-section on one side is taken through the latching hook 20 and on the other side is taken through the spring tab 38 that adjoins the latching hook 20. The second housing 3 has been pushed into the first housing 2 as far as the release members 32 such that the release members 32 bear against the latching hooks 20 and the spring tabs 38. The beveled outer surfaces 33 of the release members 32 bear against a beveled edge 35 of the latching projections 21, which are arranged on an outer side.

FIG. 9 shows the first and second electrical contacts 6, 7 of the first and second housings 2, 3 before reaching the position shown in FIG. 5. In FIG. 9, the first and second housings 2, 3 are partially mated in a region of the second contact holder 5, and the second electrical contacts 7 of the first contact holder 4 of the second housing 3 are not yet mated with the first electrical contacts 6 of the first housing 2. In the position illustrated, it is clear that the second electrical contacts 7 of the first contact holder 4, which are arranged in the second region 28, are further away from the first electrical contacts 6 of the second contact zone 31 of the first housing 2. Because of the differing heights of the first and second contact holders 4, 5 and the same heights of the first and second contact zones 30, 31, the first electrical contacts 6 of the first contact zone 30 make contact before the first electrical contacts 6 of the second contact zone 31 with the second electrical contacts 7 of the second and first contact holders 5, 4.

When the first and second housings 2, 3 reach the position shown in FIG. 5, the second electrical contacts 7 of the second contact holder 5 are fully mated with the first electrical contacts 6 of the first housing 2 and the second electrical contacts 7 of the first contact holder 4 of the second housing 3 are not yet mated with the first electrical contacts 6 of the first housing 2. As a result, the amount of force required to mate the second electrical contacts 7 of the second contact holder 5 with the first electrical contacts 6 of the first housing 2 has already been applied.

Figure 6:
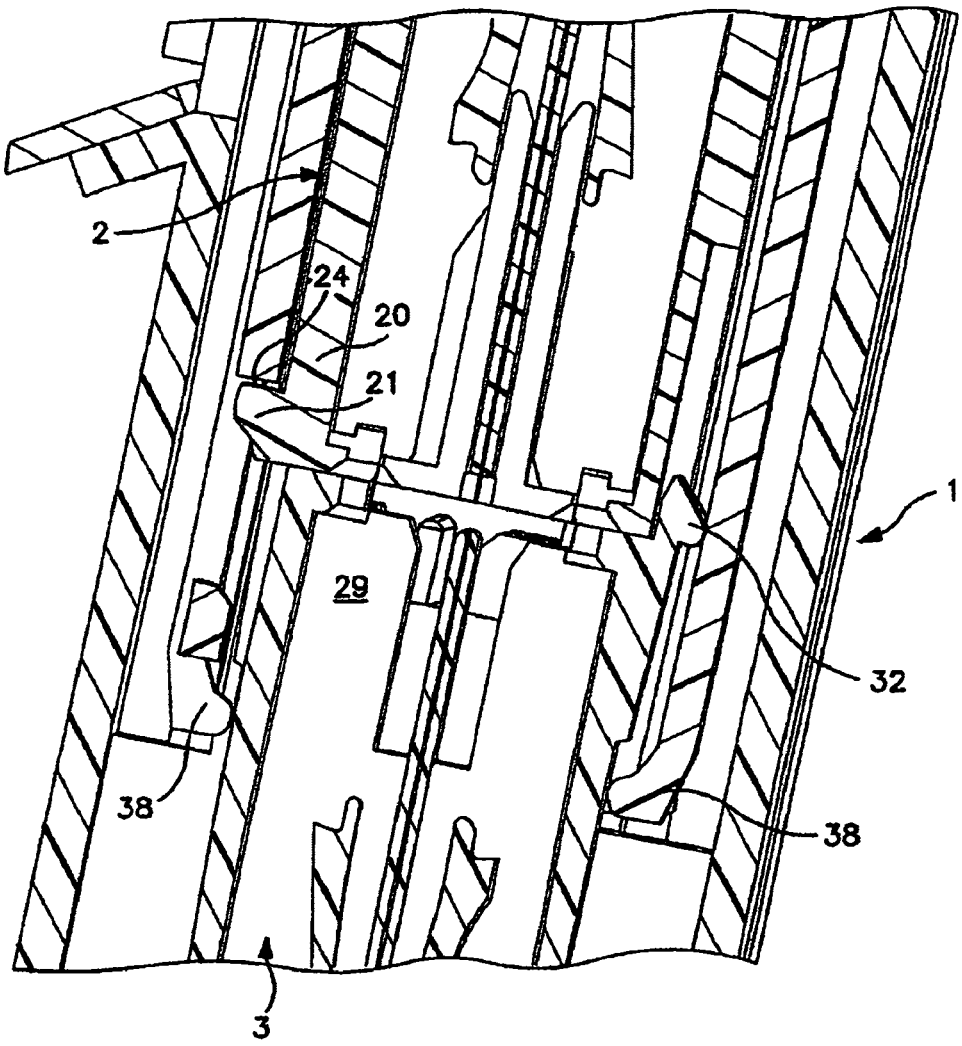
FIG. 6 is a partial cross-section view of the electrical plug connector showing the first and second housings fully mated.

As shown in FIG. 5, the release members 32 are arranged partly underneath the latching projections 21 and partly underneath the second housing wall 14. As the second housing 3 is pushed further into the first housing 2, the release members 32 bear against both the second housing wall 14 and the latching projections 21. The release members 32 press the latching projections 21 out of the first latching projection receiving recesses 23 and press the spring tabs 38 outward so that the spring tabs 38 having the first latching projection receiving recesses 23 release the latching projections 21 from the second housing wall 14. Because of this arrangement, the release members 32 act as wedges, which bend the latching projections 21 out of the first latching projection receiving recesses 23 with a low force. The latching hook receiving openings 34 of the first housing 2 receive the latching hooks 20 and the spring tabs 38. In a second position, the second contact holder 5 comes to bear against the contact base 29 of the first housing 2, and the latching projections 21 are received in the second latching projection receiving recess 24, as shown in FIG. 6. Because the latching projections 21 bear against a side portion of the second latching projection receiving recess 24, further displacement of the second contact holder 5 is prevented. The second housing 3 is pushed further into the first housing 2 in a relative movement with respect to the second contact holder 5 and the first housing 2, and the second contact holder 5 performs no further movement in relation to the first housing 2.

As shown in FIG. 10, as the second housing 3 is fully received in the first housing 2, the second electrical contacts 7 of the first contact holder 4 come into contact with the first electrical contacts 6 of the first housing 2. As the second housing 3 is pushed deeper into the first housing 2, the second electrical contacts 7 of the first contact holder 4 are pushed together with the first electrical contacts 6 of the first housing 2. Because the latching hooks 20 of the second contact holder 5 engage the second latching projection receiving recess 24 in a second position, the second electrical contacts 7 of the second contact holder 5 are pushed reliably and fully into the first electrical contacts 6 of the first housing 2. Additionally, lower mating forces are required because the second electrical contacts 7 of the second contact holder 5 have already been mated with the first electrical contacts 6 of the first contact zone 30 of the first housing 2 when the second electrical contacts 7 of the first contact holder 4 are mated with the first electrical contacts 6 of the second zone 31 of the first housing 2. In this way, and in a single plugging-in procedure, the first and second electrical contacts 6, 7 of the first second housings 2, 3 are pushed together and brought into electrically conductive contact with one another in two steps which are staggered in time so that one happens after the other.

As shown in FIG. 7, in the fully mated position, the collar 22 is arranged at a predetermined spacing above the abutment member 36 of the second housing 3. When the second housing 3 is to be unmated from the first housing 2, the relative positions of the second electrical contacts 7 of the second contact holder 5 and the first electrical contacts 6 of the first housing 2 engaged therewith do not change. Because of the contact friction, the second contact holder 5 does not change its position but, rather, performs a relative movement with respect to the second housing 3. In contrast thereto, the second electrical contacts 7 of the first contact holder 4 of the second housing 3 are disengaged from the first electrical contacts 6 of the first housing 2.

Figure 8:
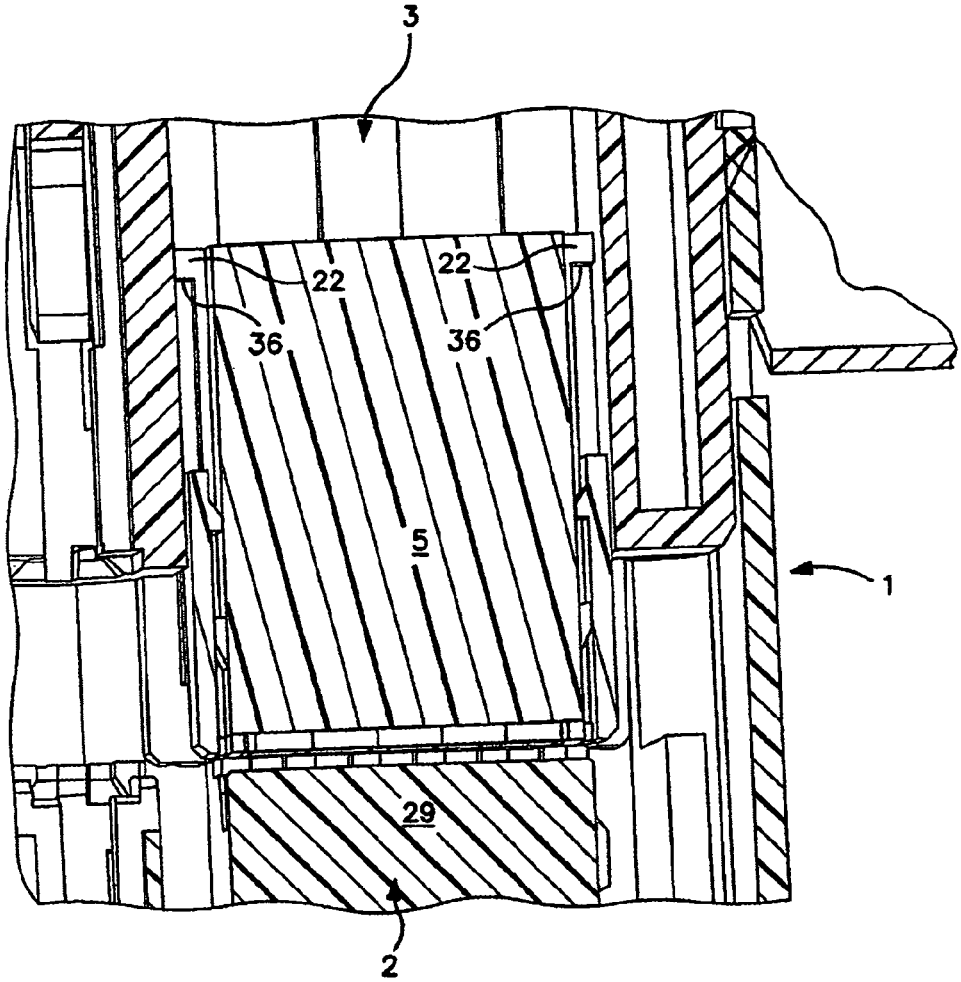
FIG. 8 is a partial cross-sectional view of the electrical plug connector showing the second contact holder during unmating of the second housing from the first housing.

The abutment member 36 engages the collar 22 when the second electrical contacts 7 of the first contact holder 4 have been pulled completely away from the first electrical contacts 6 of the first housing 2, as shown in FIG. 8. As the second housing 3 is pulled further out of the first housing 2, the abutment member 36 pulls the second contact holder 5 along with it. The second electrical contacts 7 of the second contact holder 5 are thus pulled away from the first electrical contacts 6 of the first housing 2.

As a result, only the second electrical contacts 7 of the first contact holder 4 are pulled away from the first electrical contacts 6 of the first housing 2 during initial movement of the second housing 3 away from the first housing 2. Thereafter, the second electrical contacts 7 of the second contact holder 5 are pulled away from the first electrical contacts 6 of the first housing 2. Thus, the tensile force required for unmating the first and second contacts 6, 7 is reduced by the second contact holder 5 being displaceably held in the second housing 3.

We claim:

1. An electrical plug connector, comprising:

a first housing including first electrical contacts arranged in first and second contact zones;

a second housing including second electrical contacts arranged in first and second contact holders, the second contact holder being displaceable with respect to the second housing in a direction of mating when the first and second housings are mated, the second contact holder being displaceable between a first position where the second electrical contacts of the second contact holder mechanically engage the first electrical contacts and a subsequent second position where the second electrical contacts of the first contact holder mechanically engage the first electrical contacts; and the second housing including first and second latching projection receiving recesses and the second contact holder including a latching projection, the latching projection engaging the first latching projection receiving recess in the first position and the second latching projection receiving recess in the second position, at least the first latching projection receiving recess being formed in a spring tab.

2. The electrical plug connector of claim 1, wherein in the first position the second contact holder is detachably secured to the second housing by a latching projection.

3. The electrical plug connector of claim 2, wherein the first housing includes a release member corresponding to the latching projection that unsecures the latching projection from the second housing.

4. The electrical plug connector of claim 3, wherein the release member has a wedge shape.

5. The electrical plug connector of claim 1, wherein the second contact holder extends further into the first housing than the first contact holder when the second contact holder is in the first position.

6. The electrical plug connector of claim 1, wherein the second contact holder includes a latching projection that engages the second housing and limits displacement of the second contact holder in the direction of mating.

7. The electrical plug connector of claim 1, wherein the second housing includes an abutment member that engages the second contact holder subsequent to the second electrical contacts of the first contact holder being mechanically disengaged from the first electrical contacts to pull the second contact holder from the second position to the first position.

8. The electrical plug connector of claim 1, wherein the first and second contact zones are arranged at the same level.

9. The electrical plug connector of claim 1, wherein the second contact housing includes a step on a side opposite from the direction of mating.

10. The electrical plug connector of claim 1, wherein the second electrical contacts of the second contact holder mechanically engage the first electrical contacts of the first contact zone and the second electrical contacts of the first contact holder mechanically engage the first electrical contacts of the second contact zone.

11. The electrical plug connector of claim 1, wherein the first housing includes attachment members for engaging a support structure.

12. The electrical plug connector of claim 1, wherein the first housing includes a second housing receiving recess that receives the second housing when the first and second housings are mated.

* * * * *